US009863092B2

(12) United States Patent
Oshima

(10) Patent No.: US 9,863,092 B2
(45) Date of Patent: Jan. 9, 2018

(54) SHEET PROCESSING APPARATUS AND IMAGE FORMING SYSTEM FOR CORRECTING POSTURE OF FOLDED SHEET BUNDLE

(71) Applicant: KONICA MINOLTA, INC., Chiyoda-ku, Tokyo (JP)

(72) Inventor: Keisuke Oshima, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/601,937

(22) Filed: Jan. 21, 2015

(65) Prior Publication Data

US 2015/0218754 A1 Aug. 6, 2015

(30) Foreign Application Priority Data

Feb. 4, 2014 (JP) ..... 2014-019218

(51) Int. Cl.

| | |
|---|---|
| ***B65H 37/06*** | (2006.01) |
| ***D21F 7/00*** | (2006.01) |
| ***B42C 19/02*** | (2006.01) |

(52) U.S. Cl.

CPC ..... *D21F 7/006* (2013.01); *B42C 19/02* (2013.01); *B65H 37/06* (2013.01)

(58) Field of Classification Search

CPC ..... B65H 5/32; B65H 2301/436; B65H 45/18
USPC ..... 270/32, 39.08, 52.26, 52.17, 52.18
See application file for complete search history.

(56) References Cited

U.S. PATENT DOCUMENTS 5,377,965 A * 1/1995 Mandel ..... B41L 43/12 270/37
6,796,554 B2 * 9/2004 Trovinger ..... B65H 29/06 270/32
6,817,605 B1 * 11/2004 Bohn ..... B42C 13/003 270/32

(Continued)

FOREIGN PATENT DOCUMENTS

CN 102442575 A 5/2012
JP 2006124106 A 5/2006

(Continued)

OTHER PUBLICATIONS

Japanese Office Action (and English translation thereof) dated Dec. 8, 2015, issued in counterpart Japanese Application No. 2014-019218.

(Continued)

*Primary Examiner* — Patrick H Mackey
(74) *Attorney, Agent, or Firm* — Holtz, Holtz & Volek PC

(57) ABSTRACT

A sheet processing apparatus which vertically conveys a sheet and performs sheet processing, the sheet having a folded part at a middle portion thereof and being in a vertical state with the folded part up and an edge part down, and the apparatus including: a supporting section which supports the folded part of the sheet from below; a sandwiching section which sandwiches both sides of the sheet supported by the supporting section; and a control section which controls the sandwiching section to execute a first sandwiching operation of sandwiching the sheet, to release the first sandwiching operation, and thereafter to execute a second sandwiching operation of sandwiching the sheet again.

14 Claims, 5 Drawing Sheets

(56) References Cited

U.S. PATENT DOCUMENTS

| | | | | |
|---|---|---|---|---|
| 6,827,346 | B2 * | 12/2004 | Villanueva | B42C 19/02 270/52.17 |
| 6,929,256 | B2 * | 8/2005 | Kawatsu | B42B 2/00 270/32 |
| 6,997,450 | B2 * | 2/2006 | Trovinger | B65H 5/32 270/32 |
| 7,033,123 | B2 * | 4/2006 | Trovinger | B42B 4/00 270/52.26 |
| 7,325,799 | B2 * | 2/2008 | Watkiss | B65H 45/18 270/39.06 |
| 8,109,495 | B2 * | 2/2012 | Kikkawa | B65H 45/18 270/32 |
| 8,240,654 | B2 | 8/2012 | Asami et al. | |
| 8,317,181 | B2 | 11/2012 | Suzuki | |
| 2005/0191154 | A1 * | 9/2005 | Fujimoto | B65H 29/12 412/1 |
| 2006/0153612 | A1 * | 7/2006 | Saitsu | B42C 1/12 399/410 |
| 2013/0038012 | A1 | 2/2013 | Kasuga | |

FOREIGN PATENT DOCUMENTS

| | | | |
|---|---|---|---|
| JP | 2011011912 | A | 1/2011 |
| JP | 2013035668 | A | 2/2013 |
| JP | 2013220940 | A | 10/2013 |

OTHER PUBLICATIONS

Chinese Office Action (and English translation thereof) dated Jun. 13, 2016, issued in counterpart Chinese Application No. 201510054258.4.

Chinese Office Action (and English translation thereof) dated Dec. 30, 2016, issued in counterpart Chinese Application No. 201510054258.4.

Chinese Office Action (and English translation thereof) dated Jun. 5, 2017 issued in counterpart Chinese Application No. 201510054258.4.

* cited by examiner

FIG. 6
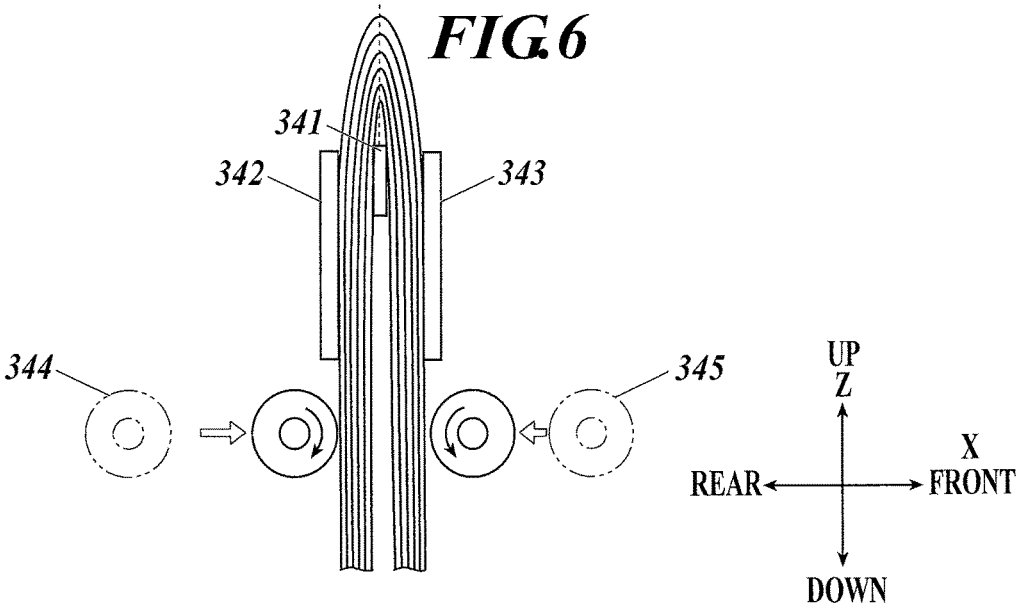
FIG. 7
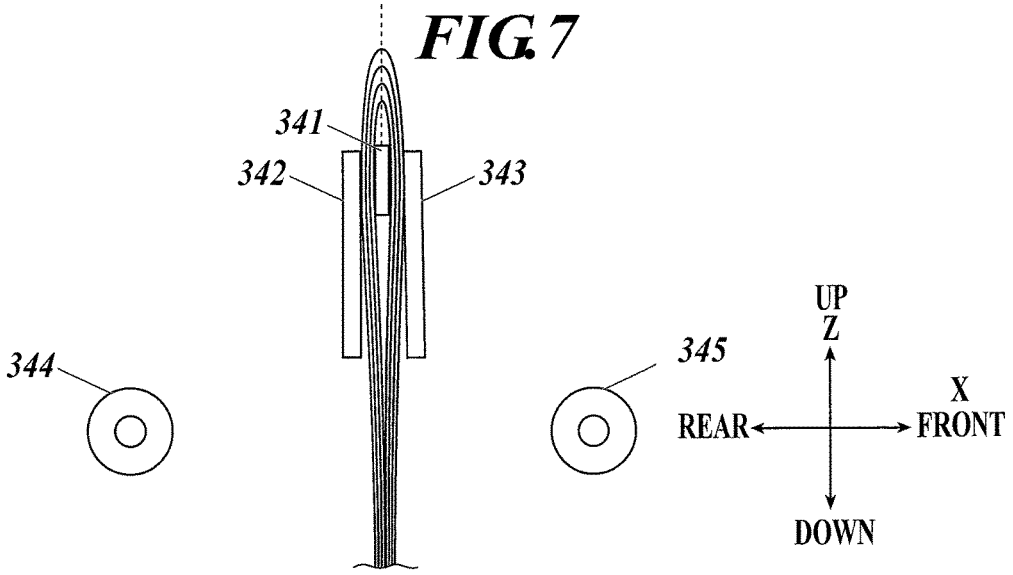
FIG. 8
T1
| | BASIS WEIGHT[gsm] | | |
|---|---|---|---|
| NUMBER OF SHEETS | 50-89 | 90-200 | 201-350 |
| 2-10 | WEAK | WEAK | MIDDLE |
| 11-34 | MIDDLE | MIDDLE(50N) | MIDDLE |
| 35-50 | STRONG | STRONG | STRONG |

SHEET PROCESSING APPARATUS AND IMAGE FORMING SYSTEM FOR CORRECTING POSTURE OF FOLDED SHEET BUNDLE

BACKGROUND OF THE INVENTION

1. Field of the Invention

The present invention relates to a sheet processing apparatus and an image forming system.

2. Description of Related Art

Conventionally, there have been known sheet processing apparatuses which perform folding and stapling with respect to sheet bundles to perform saddle stitch bookbinding, and also techniques for preventing bulging of sheet bundles and correcting postures thereof when the folding is performed to the sheet bundles (for example, see Japanese Patent Application Laid Open Publication No. 2011-11912).

In recent years, as for the sheet processing apparatuses which perform saddle stitch bookbinding, there has been suggested a configuration in which an edge trimming section is located at a lower part of the apparatus, a square back forming section is located at an upper part of the apparatus, a holding section holds sheets (sheet bundle) in a vertical state with the folded part up and the edge parts down and conveys the sheets vertically in order to make the apparatus smaller and improve operability.

Such apparatuses sometimes have had a problem that the folded part of the sheets is deformed when the sheets are held in the vertical state, and the accuracy of edge trimming becomes worse and the shape of the spine is deteriorated when various types of processing are performed in the state.

However, the technique of Japanese Patent Application Laid Open Publication No. 2011-11912 is not for holding the sheets in the vertical state with the folded part up and the edge parts down, and thus, it is difficult to correct the posture of sheets in the apparatus which locates an edge trimming section at the lower part thereof and locates the square back forming section at the upper part thereof.

SUMMARY OF THE INVENTION

The present invention has been made in consideration of the above problems in conventional techniques, and an object of the present invention is to provide a sheet processing apparatus and an image forming system which can correct postures of sheets when vertically conveying the sheets in the vertical state with the folded part up and the edge parts down.

In order to achieve the above object, according to one aspect of the present invention, there is provided a sheet processing apparatus which vertically conveys a sheet and performs sheet processing, the sheet having a folded part at a middle portion thereof and being in a vertical state with the folded part up and an edge part down, and the apparatus including: a supporting section which supports the folded part of the sheet from below; a sandwiching section which sandwiches both sides of the sheet supported by the supporting section; and a control section which controls the sandwiching section to execute a first sandwiching operation of sandwiching the sheet, to release the first sandwiching operation, and thereafter to execute a second sandwiching operation of sandwiching the sheet again.

Preferably, in the sheet processing apparatus, when the first sandwiching operation by the sandwiching section is released, the control section controls the sandwiching section to keep the sandwiching section in contact with the sheet.

Preferably, in the sheet processing apparatus, the control section controls the sandwiching section to sandwich the sheet in the first sandwiching operation with a pressing force which is smaller than a pressing force of the sandwiching section to sandwich the sheet in the second sandwiching operation.

Preferably, in the sheet processing apparatus, the sandwiching section includes a pair of plates and a plate driving section which drives the pair of plates, and the control section controls the plate driving section to execute the first sandwiching operation and the second sandwiching operation with the pair of plates.

Preferably, in the sheet processing apparatus, the sandwiching section further includes a pair of rollers and a roller driving section which drives the pair of rollers, after the first sandwiching operation is released, the control section controls the roller driving section to make the pair of rollers contact with the both sides of the sheet and to execute a rotating operation of rotating the pair of rollers in a direction that the sheet moves downward, and the control section controls the plate driving section to execute the second sandwiching operation by the pair of plates during the rotating operation of the pair of rollers or after the rotating operation is finished.

Preferably, in the sheet processing apparatus, the sandwiching section includes a pair of plates, a plate driving section which drives the pair of plates, a pair of rollers and a roller driving section which drives the pair of rollers, and the control section controls the roller driving section to execute the first sandwiching operation with the pair of rollers, and controls the plate driving section to execute the second sandwiching operation with the pair of plates.

Preferably, in the sheet processing apparatus, after the first sandwiching operation by the pair of rollers is released, the control section controls the roller driving section to make the pair of rollers contact with the both sides of the sheet, to execute a rotating operation of rotating the pair of rollers in a direction that the sheet moves downward, and to execute the second sandwiching operation by the pair of plates during the rotating operation of the pair of rollers or after the rotating operation is finished.

Preferably, the sheet processing apparatus further includes an ejection section which ejects the sheet in a state that the folded part is at the forefront of the sheet in a direction in which the sheet is ejected, wherein after the second sandwiching operation is finished, the control section controls the roller driving section to execute a back rotating operation of rotating the pair of rollers in a direction that the sheet moves upward in a state in which the pair of rollers contacts with the both sides of the sheet, and to pass the sheet to the ejection section.

Preferably, in the sheet processing apparatus, the control section changes at least one setting among a pressing force, a sandwiching time and a number of sandwiching that the sandwiching section sandwiches the sheet in the first sandwiching operation on the basis of at least one condition among a sheet type, a number of sheets and a basis weight of the sheet.

Preferably, the sheet processing apparatus further includes a trimming section which performs trimming of an edge of the sheet after the sandwiching section executes the second sandwiching operation.

Preferably, the sheet processing apparatus further includes a square back forming section which performs square back forming of the folded part of the sheet after the sandwiching section executes the second sandwiching operation.

According to another aspect of the present invention, there is provided an image forming system, including: an image forming apparatus which forms an image on a sheet; and the sheet processing apparatus which is connected to the image forming apparatus and vertically conveys the sheet having a folded part that is formed at a middle portion thereof after the image is formed by the image forming apparatus and being in a vertical state with the folded part up and an edge part down.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 6 is a schematic view for explaining a saddle stitched booklet sandwiching operation in the clamping section;

FIG. 7 is a schematic view for explaining a saddle stitched booklet sandwiching operation in the clamping section; and FIG. 8 is an example of a setting table for setting a pressing force of a first sandwiching operation.

DETAILED DESCRIPTION OF THE PREFERRED EMBODIMENT

Hereinafter, an image forming system 1 which is an embodiment of the present invention will be described with reference to the drawings.

Figure 1:
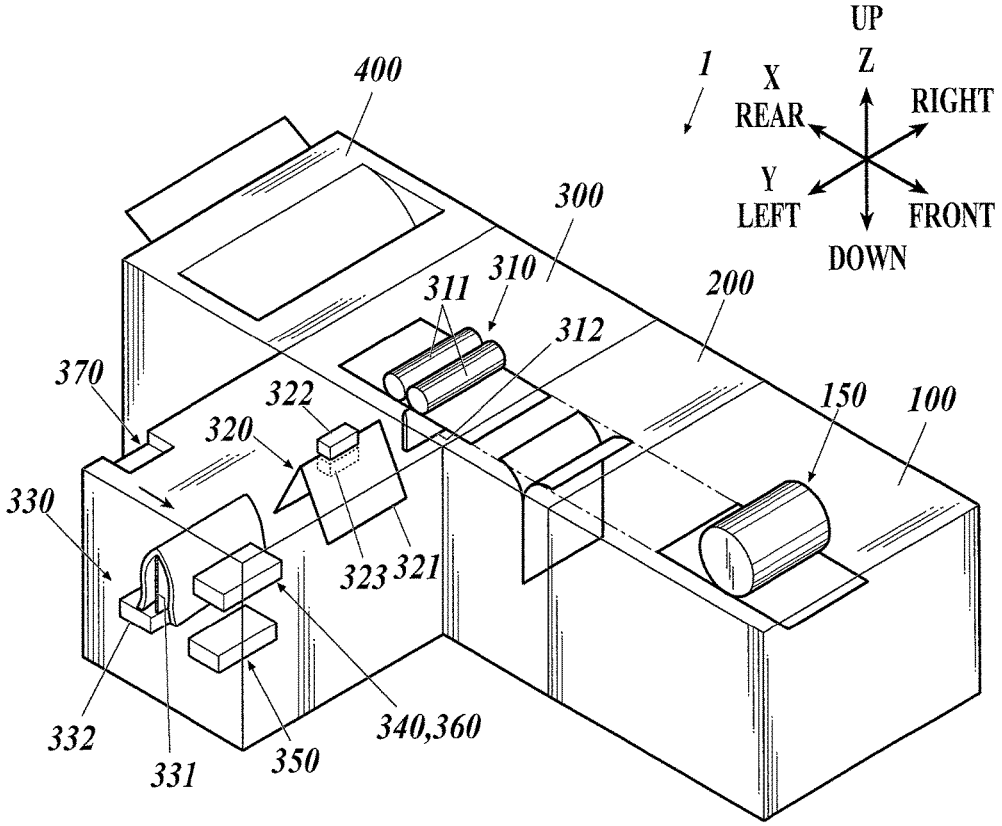
FIG. 1 is a perspective schematic view showing an entire configuration of an image forming system.

FIG. 1 is a perspective schematic view showing the entire configuration of the image forming system 1.

As shown in FIG. 1, the image forming system 1 includes an image forming apparatus 100, an intermediate conveyance apparatus 200, a sheet processing apparatus 300 and a side stitching apparatus 400.

In the following description, the vertical direction is referred to as Z direction; the direction of an array of the image forming apparatus 100, the intermediate conveyance apparatus 200, the sheet processing apparatus 300 and the side stitching apparatus 400 in FIG. 1 is referred to as X direction; and the direction orthogonal to both the X and Z directions is referred to as Y direction.

The X direction has front and rear sides, and the Y direction has right and left sides. The front side is upstream and the rear side is downstream when a sheet is conveyed in the image forming system 1. The right side is upstream and the left side is downstream when a sheet is conveyed for half folding and saddle stitching processing by the sheet processing apparatus 300.

The image forming apparatus 100 forms an image on a sheet.

Specifically, the image forming apparatus 100 for forming an image on a sheet includes, for example, a conveyance section to extract and convey a sheet from the sheets stored as recording media from a sheet tray, a developing section to develop a toner image based on bitmap data onto a first transfer member such as a transfer roller, a first transfer section to transfer the toner image developed on the first transfer member onto a second transfer member such as a transfer drum 150, a second transfer section to transfer the toner image on the second transfer member onto the sheet conveyed by the conveyance section, a fixing section to fix the transferred toner image onto the sheet, and an ejecting section to eject the sheet after the fixation by the fixing section.

The image forming apparatus 100 passes the ejected sheet on which the image is formed to the intermediate conveyance apparatus 200. That is, the connection in the image forming system 1 allows the sheet ejected from the image forming apparatus 100 to be passed to the intermediate conveyance apparatus 200.

The intermediate conveyance apparatus 200 can make the sheet standby temporarily and crease and trim the sheet.

Specifically, the intermediate conveyance apparatus 200 includes, for example, a standby section (stacker) which conveys downward a sheet conveyed from the image forming apparatus 100 and makes the sheet stop once to standby with the sheet surface located along the Z direction; an alignment section which aligns the position of the sheet during the standby; a scoring section (creaser) which scores the aligned sheet; and a trimming section (slitter) which trims off margins in the sheet while conveying the scored sheet.

That is, the intermediate conveyance apparatus 200 once stops the sheet passed from the image forming apparatus 100 at the standby section, aligns the sheet with the alignment section, scores the sheet with the scoring section, and thereafter trims the margins in the sheet with the trimming section while conveying the scored sheet. Then, the intermediate conveyance apparatus 200 passes the sheet with the margins trimmed off by the trimming section to the sheet processing apparatus 300.

The intermediate conveyance apparatus 200 can also pass the sheet received from the image forming apparatus 100 to the sheet processing apparatus 300 without performing a part or all of the various types of processing by the intermediate conveyance apparatus 200.

The sheet processing apparatus 300 performs half folding that is folding the sheet in half (in two), saddle stitching that is stapling a predetermined number of stacked sheets which were folded in half to create a saddle-stitched booklet, trimming that is trimming edges of the saddle-stitched booklet, square back forming that is forming a square back as a spine of the saddle-stitched booklet, and such like.

Specifically, the sheet processing apparatus 300 includes, for example, a half folding section 310 which folds the sheet received from the intermediate conveyance apparatus 200 in half along the Y direction, a saddle stitching section 320 which overlies the sheets folded in half by the half folding section 310 and inserts staples into the sheets to form a saddle-stitched booklet, a sheet conveyance mechanism 330 which receives the saddle-stitched booklet saddle-stitched by the saddle stitching section 320 and conveys the saddle-stitched booklet in the direction (X direction) orthogonal to the folding line in the horizontal plane, a clamping section 340 which sandwiches and holds, around the folding line, the saddle-stitched booklet conveyed by the sheet conveyance mechanism 330, a trimming section 350 which trims the edges of the saddle-stitched booklet held by the clamping section 340, a square back forming section 360 which forms a square back as the spine of the saddle-stitched booklet, and an ejection section 370 which ejects the saddle-stitched booklet outside.

The sheet processing apparatus 300 can also pass the sheet received from the intermediate conveyance apparatus 200 to the side stitching apparatus 400 without performing a part or all of the various types of processing by the sheet processing apparatus 300.

The half folding section 310 includes a pair of half folding rollers 311 and 311 and a plate-like folding knife 312 which is located below the pair of half folding rollers 311 and 311 along the Y-Z plane and movable so as to come between the half folding rollers 311 and 311, for example.

The sheet passed from the image forming apparatus 100 is conveyed to the position where the central portion in the X direction of the sheet faces the folding knife 312. The folding knife 312 comes between the half folding rollers 311 and 311 and presses the sheet to the nip section. Thus, the sheet is folded in half with the folding line formed along the Y direction at the position contacting the folding knife 312. That is, the sheet is in what is called a mountain fold shape (mountain-folded sheet) with the folding line up and the both edges down.

The half-folded sheet is conveyed in a direction (Y direction) along the folding line by a conveyance section not shown in the drawings and reaches the saddle stitching section 320.

The saddle stitching section 320 includes a saddle section 321 for overlying and accumulating the sheets which were conveyed from the half folding section 310, a stapling section 322 which is provided above the saddle section 321, a receiving section 323 provided inside the saddle section 321, and such like.

When a predetermined number of sheets are accumulated on the saddle section 321, staples are inserted along the folding line of the sheet bundle by the cooperation between the stapling section 322 and the receiving section 323 to form a saddle-stitched booklet. The formed saddle-stitched booklet is pushed out to the downstream sheet conveyance mechanism 330 by an alignment section (not shown in the drawings) provided at the right end (the end upstream in the conveyance direction) of the saddle section 321.

The sheet, conveyance mechanism 330 includes a moving saddle 331 which is a plate-like member provided along Y-Z plane and a movement unit 332 which is reciprocatable in the X direction.

The saddle-stitched booklet pushed out from the saddle stitching section 320 is supported by the moving saddle 331 at the folded part (stitched part) from below. When the saddle-stitched booklet is supported by the moving saddle 331, the movement unit 332 moves from the rear side to the front side in the X direction to pass the saddle-stitched booklet to the clamping section 340.

Figure 2:
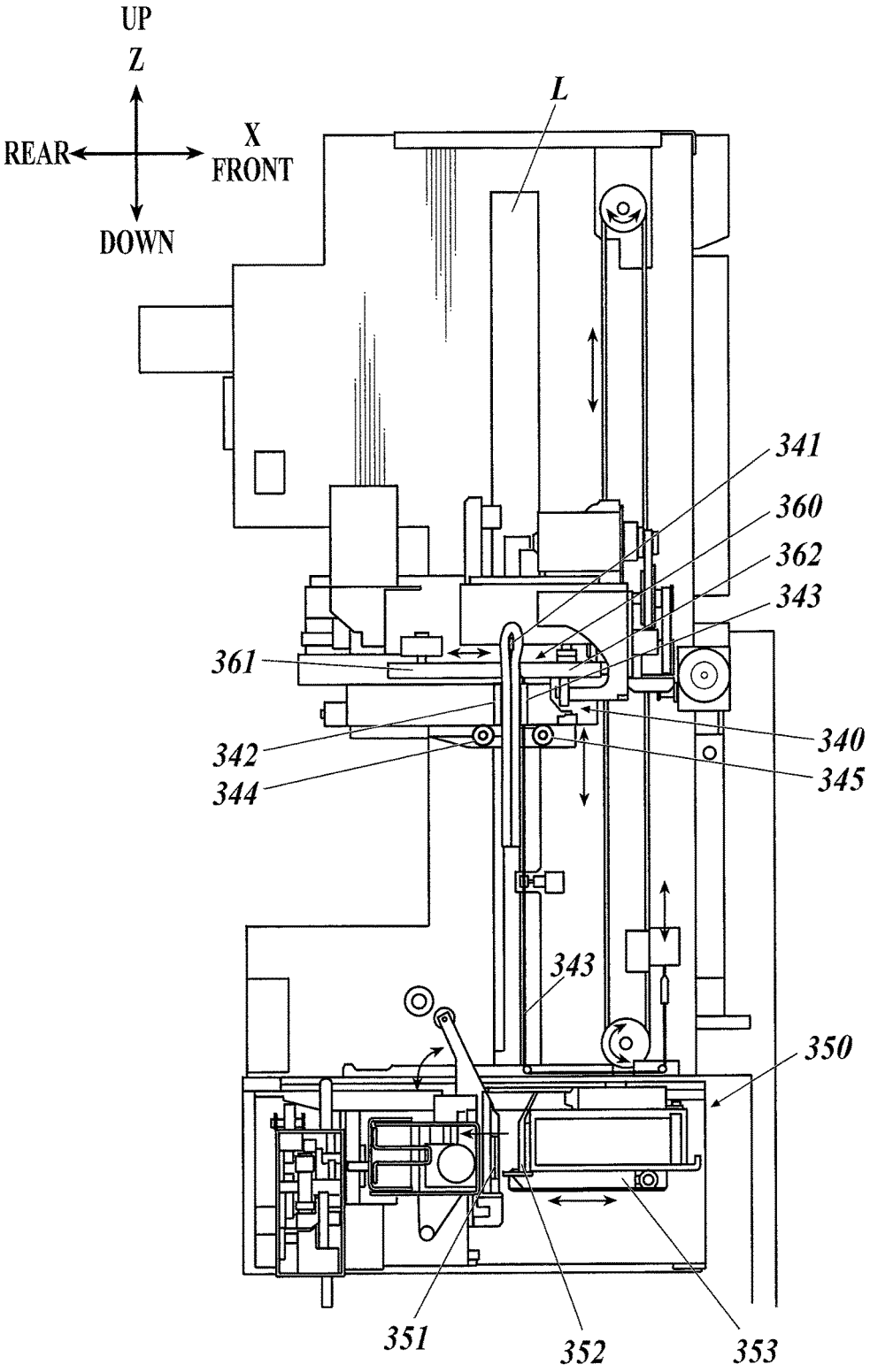
FIG. 2 is a view showing an example of a configuration of clamping section, trimming section and square back forming section.

FIG. 2 is a view showing an example of a configuration of the clamping section 340, the trimming section 350 and the square back forming section 360 in the sheet processing apparatus 300.

As shown in FIG. 2, the clamping section 340 is provided above the trimming section 350 so as to be movable up and down along a guide rail L provided along the Z direction.

Figure 3:
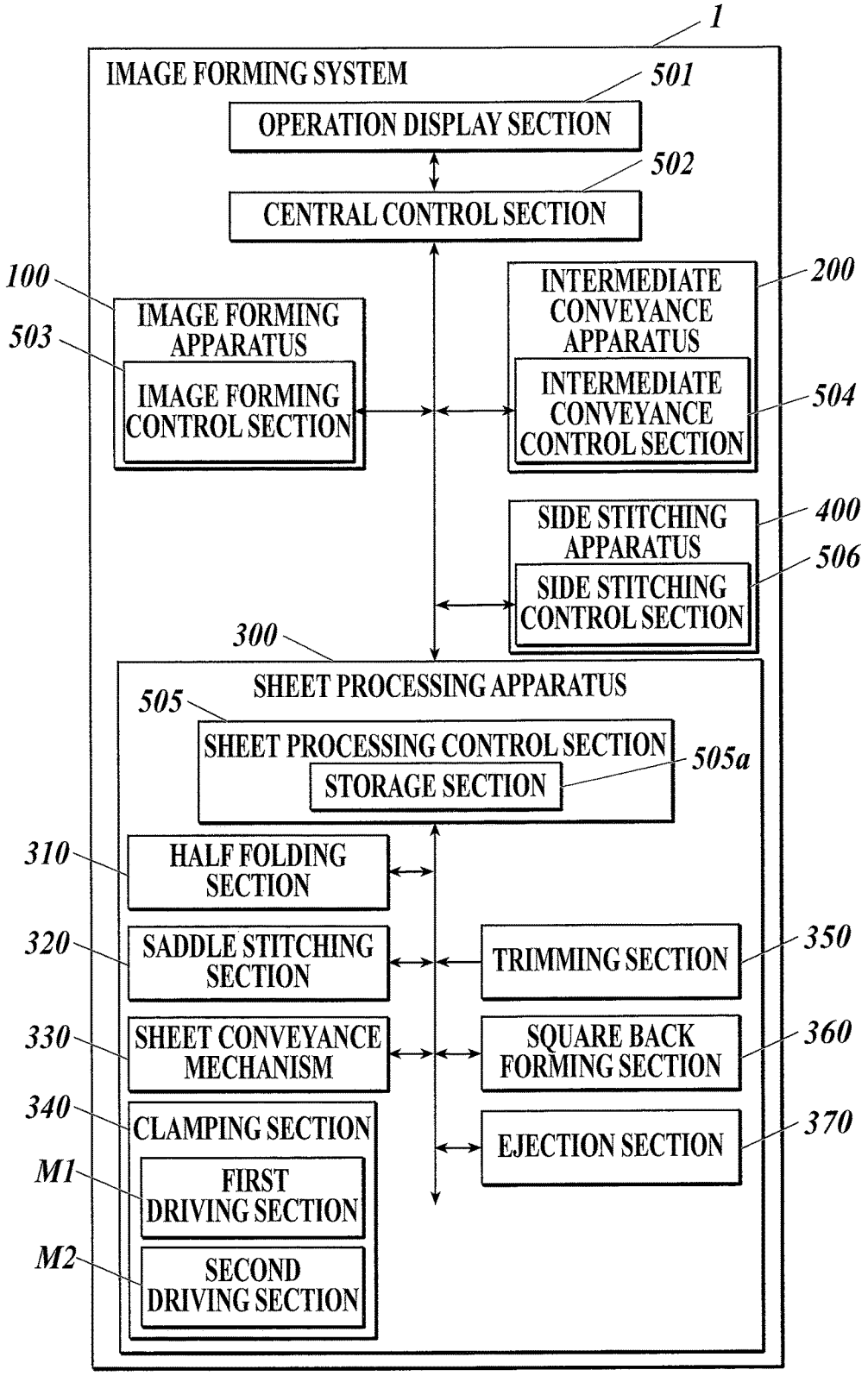
FIG. 3 is a block diagram showing a main configuration according to operation control of the image forming system.

The clamping section 340 includes a lifter plate (supporting section) 341, a pair of sandwiching plates (a pair of plates) 342 and 343, a pair of pressing rollers (a pair of rollers) 344 and 345, a first driving section (plate driving section) M1 (see FIG. 3) and a second driving section (roller driving section) M2 (see FIG. 3).

The pair of sandwiching plates 342 and 343, the pair of pressing rollers 344 and 345, the first driving section M1 and the second driving section M2 function as a sandwiching section.

The lifter plate 341 is driven by a driving section which is not shown in the drawings and supports the folded part of the saddle-stitched booklet conveyed from the rear side to the front side by the sheet conveyance mechanism 330 by raising the folded part so as to be hung up from below.

The pair of sandwiching plates 342 and 343 is a pair of plates which is driven by the first driving section M1 and movable so as to be close to or away from each other in the X direction. The pair of sandwiching plates 342 and 343 executes a first sandwiching operation and a second sandwiching operation.

Specifically, when the clamping section 340 is lowered while the saddle-stitched booklet is located between the clamping section 340 and the trimming section 350, the pair of sandwiching plates 342 and 343 is positioned at a position to sandwich the saddle-stitched booklet therebetween around the folded part of the saddle-stitched booklet supported by the moving saddle 331. When the lifter plate 341 supports the saddle-stitched booklet by raising the booklet so as to be hung up from below, the pair of sandwiching plates 342 and 343 executes the first sandwiching operation for correcting the posture of saddle-stitched booklet, and after the first sandwiching operation is released, the pair of sandwiching plates 342 and 343 executes the second sandwiching operation for sandwiching the saddle-stitched booklet again. By the second sandwiching operation, the clamping section 340 clamps the saddle-stitched booklet.

The pair of pressing rollers 344 and 345 is a pair of rollers which is provided to be lower than the pair of sandwiching plates 342 and 343 and long in the Y direction.

The pair of pressing rollers 344 and 345 is set so as to face the position of the saddle-stitched booklet supported by the lifter plate 341, the position being upper than the central portion in the Z direction.

The pair of pressing rollers 344 and 345 is driven by the second driving section M2, movable so as to be close to or away from each other in the X direction, and can sandwich the saddle-stitched booklet from the both sides of the X direction. The pair of pressing rollers 344 and 345 is driven by the second driving section M2 and is rotatable in directions that the saddle-stitched booklet moves upward and downward, respectively.

Thus, after the first sandwiching operation by the pair of sandwiching plates 342 and 343 is released, the pair of pressing rollers 344 and 345 contacts the saddle-stitched booklet from both sides in the X direction, performs rotating operation of rotating in a direction to move the saddle-stitched booklet downward, and thereby, pulls the outermost sheets of the booklet downward and corrects the shift of the outermost sheets of the booklet.

After the rotating operation of the pair of pressing rollers 344 and 345 is finished, the second sandwiching operation by the pair of sandwiching plates 342 and 343 is executed.

Further, after the second sandwiching operation by the pair of sandwiching plates 342 and 343 is finished (alternatively, after the trimming by the trimming section 350 and/or square back forming by the square back forming section 360), the pair of pressing rollers 344 and 345 contacts the saddle-stitched booklet from both sides in the X direction and performs a back rotating operation of rotating in a direction to move the saddle-stitched booklet upward, and thereby conveys the saddle-stitched booklet upward. Thus, the saddle-stitched booklet is conveyed from the lower side to the upper side in the vertical state.

After the pair of sandwiching plates 342 and 343 sandwich the saddle-stitched booklet therebetween, the movement unit 332 retreats backward.

By the clamping section 340 being lowered while holding the saddle-stitched booklet (second sandwiching state), the edge sides of the saddle-stitched booklet can enter the trimming section 350.

As described above, in the embodiment, the pair of sandwiching plates 342 and 343 performs the first sandwiching operation and the second sandwiching operation, and the pair of pressing rollers 344 and 345 performs the rotating operation between the first sandwiching operation and the second sandwiching operation. By a series of the operations, it is possible to correct the posture of the saddle-stitched booklet in the vertical state and perform clamping. The details of the series of operations will be described later.

The trimming section 350 includes trimming sandwiching members 351 and 352, and the edges of the saddle-stitched booklet come to a predetermined position in a gap between the trimming sandwiching members 351 and 352. When the edges of the saddle-stitched booklet come to the predetermined position in the gap between the trimming sandwiching members 351 and 352, a trimming blade 353 moves in the Y direction and trims the ends of the edges of the saddle-stitched booklet. Thus, the edge parts of the saddle-stitched booklet which are not aligned are cut to be aligned.

The square back forming section 360 is loaded on the clamping section 340.

The square back forming section 360 is configured by including holding plates 361 and 362, a roller not shown in the drawings) and such like. The holding plates 361 and 362 are located above the pair of sandwiching plates 342 and 343 in the clamping section 340.

When executing the square back forming, after the first sandwiching operation of the pair of sandwiching plates 342 and 343 and the rotating operation of the pair of pressing rollers 344 and 345, the saddle-stitched booklet is slightly lifted by the lifter plate 341, and the holding plates 361 and 362 sandwich the saddle-stitched booklet around the folded part above the sandwiching position of the pair of sandwiching plates 342 and 343. At this time, the lifting amount of the saddle-stitched booklet is approximately 7 mm at most, and even after the operation, the position sandwiched by the pair of sandwiching plates 342 and 343 is still around the folded part of the saddle-stitched booklet.

Thereafter, the pair of sandwiching plates 342 and 343 performs the second sandwiching operation, the lifter plate 341 is moved in the Y direction to be drawn, the folded part of the saddle-stitched booklet is crushed to be flattened by the roller, and the folded part is formed in a square shape. After the square back forming is finished, the holding plates 361 and 362 move away from the saddle-stitched booklet.

The ejection section 370 is located above the clamping section 340. The ejection section 370 includes a stacking section which is located on the upper surface of the sheet processing apparatus 300 and a direction changing section which receives the saddle-stitched booklet from the clamping section 340 and ejects the booklet to the stacking section.

The saddle-stitched booklet which was conveyed in the vertical state from lower side to upper side by the pair of pressing rollers 344 and 345 of the clamping section 340 is made to change the direction to be in a nearly horizontal posture by the direction changing section of the ejection section 370 and ejected so as to be stacked on each other sequentially on the stacking section.

Returning to FIG. 1, the side stitching apparatus 400 performs side stitching to a plurality of sheets.

Specifically, the side stitching apparatus 400 includes a stapling section which staples the plurality of sheets received from the sheet processing apparatus 300, a page end trimming section which performs end trimming to cut off a part of end portions parallel to the spine of the plurality of stapled sheets so as to align the end portions, and an ejecting section which ejects the sheets after processing by the connected apparatuses, for example.

The side stitching apparatus 400 can also eject the sheets received from the sheet processing apparatus 300 without performing a part or all of the various types of processing by the side stitching apparatus 400.

Next, the operation control in the image forming system 1 will be described.

FIG. 3 is a block diagram showing the main configuration according to the operation control in the image forming system 1.

The image forming system 1 includes an operation display section 501 which receives an input operation from a user according to the operation in the image forming system 1 and performs display according to the operation in the image forming system 1, a central control section 502 which controls operations in the entire image forming system 1, an image forming control section 503 which controls operations of the image forming apparatus 100, an intermediate conveyance control section 504 which controls operations of the intermediate conveyance apparatus 200, a sheet processing control section (control section) 505 which controls operations of the sheet processing apparatus 300 and a side stitching control section 506 which controls operations of the side stitching apparatus 400.

The operation display section 501 includes, for example, a touch panel type operation display device or switches and keys for various types of input to, send a signal according to the input from the user to the central control section 502.

Each of the central control section 502, the image forming control section 503, the intermediate conveyance control section 504 and the side stitching control section 506 includes a CPU (Central Processing Unit), a RAM (Random Access Memory), a ROM (Read Only Memory) and such like to read out a software program and various types of data according to processing and execute the processing.

The sheet processing control section 505 also includes a CPU, RAM, storage section **505*a* and such like to read out a software program and various types of data according to processing and execute the processing. The storage section 505*a*** is a non-volatile memory which is readable and writable, or the like.

The central control section 502 sets various types of conditions in the image forming system 1 in accordance with the input from the user via the operation display section 501.

The setting conditions include, for example, a sheet size, the number of colors to form images (for example, full-color, gray scale or monochrome), the number of sheets to be folded in half, the number of a part of the sheets to be saddle-stitched, the type, size and basis weight of sheets to be saddle-stitched, the number of staples to be inserted into the folding line of sheets for saddle stitching, a position to insert the staples (stapling position) for saddle stitching, whether to perform the trimming of edge parts of saddle-stitched booklet, and whether to perform square back forming of folded part of the saddle-stitched booklet.

Then, the central control section 502 outputs instructions to perform processing according to the setting to respective control sections of the image forming control section 503, the intermediate conveyance control section 504, the sheet processing control section 505 and the side stitching control section 506. The control sections control operations of the apparatuses which are respective control targets according to the instructions.

For example, the central control section 502 outputs an instruction for performing half folding, saddle stitching, edge trimming, square back forming and such like to the sheet processing control section 505.

In response to this, the sheet processing control section 505 controls the half folding section 310, the saddle stitching section 320, the trimming section 350 and the square back forming section 360 to perform the processing. The sheet processing control section 505 controls the ejection section 370 to eject the saddle-stitched booklet.

In the embodiment, the sheet processing control section 505 further controls the first driving section M1 while supporting the saddle-stitched booklet by the lifter plate 341 of the clamping section 340, and performs the first sandwiching operation and the second sandwiching operation of sandwiching the booklet from both sides of the X direction with the pair of sandwiching plates 342 and 343. The sheet processing control section 505 also controls the second driving section M2 and performs the rotating operation with the pair of pressing rollers 344 and 345 between the first sandwiching operation and the second sandwiching operation by the pair of sandwiching plates 342 and 343.

Hereinafter, details of such operations by the pair of sandwiching plates 342 and 343 and the pair of pressing rollers 344 and 345 will be described by using FIGS. 4 to 7.

Figure 4:
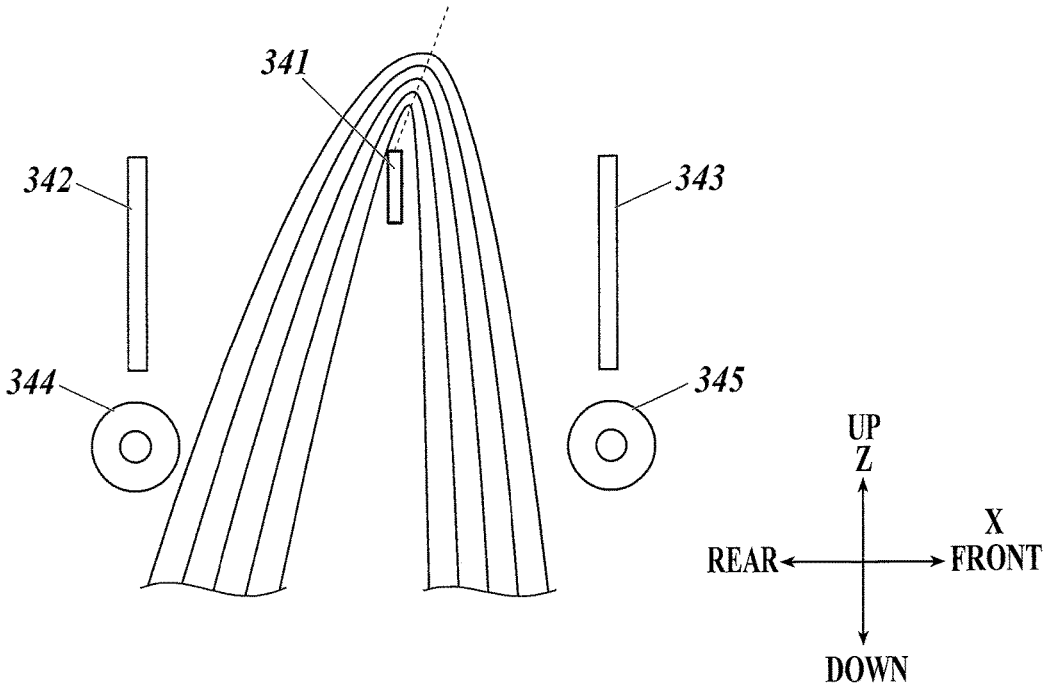
FIG. 4 is a schematic view for explaining a saddle stitched booklet sandwiching operation in the clamping section.

When the saddle-stitched booklet supported by the moving saddle 331 is conveyed to the lower part of the clamping section 340, as shown in FIG. 4, the lifter plate 341 of the clamping section 340 supports the saddle-stitched booklet so as to hook up from below to lift it up.

FIG. 4 shows a state in which the saddle-stitched booklet is inclined.

Next, the sheet processing control section 505 controls the first driving section M1 to move the pair of sandwiching plates 342 and 343 to a direction of approaching each other until they are located with a predetermined distance (first predetermined distance) therebetween which is set in advance (first sandwiching operation).

Here, the first predetermined distance is a distance which allows application to the booklet of a pressing force of a degree that can slightly push the booklet from both sides in the X direction.

Figure 5:
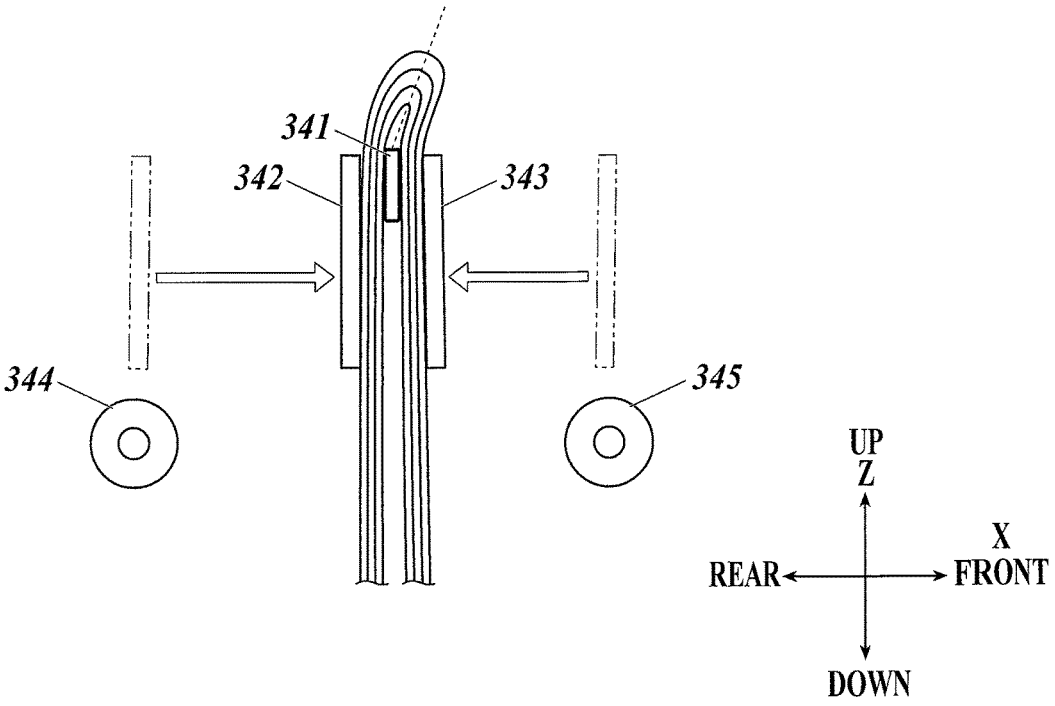
FIG. 5 is a schematic view for explaining a saddle stitched booklet sandwiching operation in the clamping section.

Thus, as shown in FIG. 5, the saddle-stitched booklet is first-sandwiched by the pair of sandwiching plates 342 and 343.

Next, the sheet processing control section 505 controls the first driving section M1 to move the pair of sandwiching plates 342 and 343 to a direction to be away from each other until they are located away from each other for a predetermined distance (second predetermined distance) which is set in advance (release operation of first sandwiching operation).

Here, the second predetermined distance is a distance that can keep the pair of sandwiching plates 342 and 343 in contact with the booklet.

Thus, as shown in FIG. 6, the pair of sandwiching plates 342 and 343 contacts the outermost sheets of the saddle-stitched booklet and leads to a state in which the bulging of saddle-stitched booklet is suppressed, which is preferable.

Next, the sheet processing control section 505 controls the second driving section M2 to make the pair of pressing rollers 344 and 345 contact the saddle-stitched booklet from both sides, and in this state, make the pair of pressing rollers 344 and 345 rotate in the direction to move the saddle-stitched booklet downward (rotating operation).

Thus, as shown in FIG. 6, the outermost sheets of the saddle-stitched booklet are pulled downward and the shift of the outermost sheets of the saddle-stitched booklet is corrected. Especially, when the saddle-stitched booklet has a cover which is thicker and has a higher rigidity than sheets inside the booklet as the outermost sheet, the rotating operation of the pair of pressing rollers 344 and 345 is effective in order to correct the shift of the cover.

Next, the sheet processing control section 505 controls the second driving section M2 to move the pair of pressing rollers 344 and 345 away from the booklet.

Then, the sheet processing control section 505 controls the first driving section M1 to move the pair of sandwiching plates 342 and 343 to a direction of approaching each other until they are located to be away for a predetermined distance (third predetermined distance) which is set in advance (second sandwiching operation).

Here, the third predetermined distance is a distance that allows application to the booklet of pressing force of a degree that can push and hold the booklet from the both sides (X direction). The third predetermined distance is set to be smaller than the first predetermined distance of the first sandwiching operation. Therefore, in the embodiment, the pressing force for sandwiching the booklet in the first sandwiching operation is set to be smaller than the pressing force for sandwiching the booklet in the second sandwiching operation.

Thus, as shown in FIG. 7, the saddle-stitched booklet is second-sandwiched by the pair of sandwiching plates 342 and 343.

Here, the second sandwiching operation is described to be executed after the rotating operation of the pair of pressing rollers 344 and 345 is finished (after the pair of pressing rollers 344 and 345 is moved away from the saddle-stitched booklet); however, the second sandwiching operation may be executed during the rotating operation of the pair of pressing rollers 344 and 345. In this case, the pair of pressing rollers 344 and 345 may be away from the saddle-stitched booklet after the second sandwiching operation by the pair of sandwiching plates 342 and 343.

Thereafter, in the state in which the pair of sandwiching plates 342 and 343 sandwiches the saddle-stitched booklet therebetween, the clamping section 340 is moved up and down and the trimming and square back forming are executed.

When the processing is finished, the sheet processing control section 505 controls the second driving section M2 to make the pair of pressing rollers 344 and 345 contact the saddle-stitched booklet from both sides of the X direction, and in this state, make the pair of pressing rollers 344 and 345 rotate (back rotating operation) in the direction to move the saddle-stitched booklet upward.

Thus, the saddle-stitched booklet is conveyed upward.

As described above, according to the embodiment, in the sheet processing apparatus 300 which vertically conveys a saddle-stitched booklet and performs sheet processing, the saddle-stitched booklet having a folded part at the middle portion thereof and being in a vertical state with the folded part up and the edge parts down, the sheet processing apparatus 300 includes a lifter plate 341 which supports the folded part of the saddle-stitched booklet from below, a sandwiching section which sandwiches, from both sides, the saddle-stitched booklet supported by the lifter plate 341, and a sheet processing control section 505 which executes a first sandwiching operation of sandwiching the saddle-stitched booklet with the sandwiching section, releases the first sandwiching operation by the sandwiching section, and thereafter, executes a second sandwiching operation of sandwiching the saddle-stitched booklet again with the sandwiching section.

Thus, it is possible to sandwich the saddle-stitched booklet by the second sandwiching operation after correcting the inclination of saddle-stitched booklet being supported by the lifter plate 341 by the first sandwiching operation. Therefore, when a sheet in the vertical state is to be conveyed vertically, the posture of the saddle-stitched booklet can be corrected and the sheet processing can be executed without having a deformation at the folded part of the saddle-stitched booklet.

According to the embodiment, when releasing the first sandwiching operation by the sandwiching section, the sheet processing control section 505 controls the sandwiching section to keep the sandwiching section in contact with the booklet.

Thus, it is possible to suppress the re-bulging and shift of the posture of the saddle-stitched booklet which was corrected by the first sandwiching operation.

According to the embodiment, the sheet processing control section 505 controls the sandwiching section to sandwich the booklet in the first sandwiching operation with a pressing force which is smaller than the pressing force of the sandwiching section to sandwich the booklet in the second sandwiching operation.

Thus, since the pressing amount of the first sandwiching operation can be small, it is possible to execute the first sandwiching operation rapidly and correct the posture of the saddle-stitched booklet more efficiently.

According to the embodiment, the sandwiching section includes a pair of sandwiching plates 342 and 343 and a first driving section M1 which drives the pair of sandwiching plates 342 and 343, and the sheet processing control section 505 controls the first driving section M1 to execute the first sandwiching operation and the second sandwiching operation with the pair of sandwiching plates 342 and 343.

Thus, since the first sandwiching operation and the second sandwiching operation can be executed only by controlling the operation of the pair of sandwiching plates 342 and 343, it is possible to prevent the apparatus configuration from being complicated.

According to the embodiment, the sandwiching section further includes a pair of pressing rollers 344 and 345 and a second driving section M2 which drives the pair of pressing rollers 344 and 345, and the sheet processing control section 505 controls the first driving section M1 to release the first sandwiching operation by the pair of sandwiching plates 342 and 343, and thereafter, controls the second driving section M2 to make the pair of pressing rollers 344 and 345 contact the booklet from both sides and execute the rotating operation of rotating the pair of pressing rollers 344 and 345 in a direction to move the saddle-stitched booklet downward. After the rotating operation of the pair of pressing rollers 344 and 345 is finished, the sheet processing control section 505 controls the first driving section M1 to execute the second sandwiching operation by the pair of sandwiching plates 342 and 343.

Thus, after the posture of the saddle-stitched booklet is corrected by the first sandwiching operation, the shift of the outermost sheets of the saddle-stitched booklet is corrected by the pair of pressing rollers 344 and 345, and thereafter, the second sandwiching operation is executed.

Therefore, it is possible to correct the posture of the saddle-stitched booklet more effectively.

According to the embodiment, the sheet processing apparatus includes an ejection section 370 which ejects the saddle-stitched booklet in a state that the folded part is at the forefront of the booklet in a direction in which the booklet is ejected, and after the second sandwiching operation is finished, the sheet processing control section 505 controls the second driving section M2 to execute a back rotating operation of rotating the pair of pressing rollers 344 and 345 in a direction to move the saddle-stitched booklet upward in a state in which the pair of pressing rollers 344 and 345 contacts the both sides of the saddle-stitched booklet, and pass the saddle-stitched booklet to the ejection section 370.

Thus, it is possible to convey the sheet in the vertical state upward to be ejected from the ejection section 370 by the pair of pressing rollers 344 and 345.

According to the embodiment, the sheet processing apparatus further includes a trimming section 350 which performs trimming of edges of the saddle-stitched booklet after the sandwiching section executed the second sandwiching operation.

Thus, since the posture of the saddle-stitched booklet is corrected by the second sandwiching operation, it is possible to perform highly accurate trimming.

According to the embodiment, the sheet processing apparatus further includes a square back forming section 360 which performs square back forming of the folded part of the saddle-stitched booklet after the sandwiching section executed the second sandwiching operation.

Thus, since the posture of the saddle-stitched booklet is corrected by the second sandwiching operation, it is possible to perform highly accurate square back forming without deteriorating the shape of the spine part.

It goes without saying that the detailed configurations and the detailed operations of the components of the sheet processing apparatus 300 in the embodiment can be appropriately changed within the scope of the present invention.

For example, the embodiment has been described by illustrating the configuration including the pair of pressing rollers 344 and 345 and the second driving section M2; however, the configuration may not include the above sections.

Even by a configuration not including the above sections, the first sandwiching operation is executed by the pair of sandwiching plates 342 and 343, and thus, it is possible to obtain the effect of correcting the posture of the saddle-stitched booklet in the vertical state.

The embodiment has been described by illustrating a configuration in which the sheet processing control section 505 controls the sandwiching section to keep the sandwiching section in contact with the booklet when releasing the first sandwiching operation by the sandwiching section; however, the sandwiching section may be moved away from the booklet when releasing the first sandwiching operation.

Even by such configuration, it is possible to obtain the effect of correcting the posture of the saddle-stitched booklet in the vertical state by the first sandwiching operation.

The embodiment has been described by illustrating a configuration in which the sheet processing control section 505 controls the sandwiching section to sandwich the saddle-stitched booklet in the first sandwiching operation with a pressing force which is smaller than the pressing force of the sandwiching section to sandwich the saddle-stitched booklet in the second sandwiching operation; however, the pressing forces of the sandwiching section to sandwich the saddle-stitched booklet in the first sandwiching operation and the second sandwiching operation may be the same.

Even by such configuration, it is possible to obtain the effect of correcting the posture of the saddle-stitched booklet in the vertical state by the first sandwiching operation.

The embodiment has been described by illustrating a configuration in which the pair of sandwiching plates 342 and 343 executes the first sandwiching operation and the second sandwiching operation; however, the first sandwiching operation can be executed by the pair of pressing rollers 344 and 345.

In this case, first, the sheet processing control section 505 executes the first sandwiching operation with the pair of pressing rollers 344 and 345 and slightly increases the gap between the pressing rollers 344 and 345 to release the first sandwiching operation by the pair of pressing rollers 344 and 345. Thereafter, the sheet processing control section 505 executes a rotating operation of rotating the pair of pressing rollers 344 and 345 in the direction to move the saddle-stitched booklet downward while the pair of pressing rollers 344 and 345 contacts the both sides of the saddle-stitched booklet. Then, during or after the rotating operation of the pair of pressing rollers 344 and 345, the sheet processing control section 505 executes the second sandwiching operation by the pair of sandwiching plates 342 and 343.

Even by such configuration, it is possible to obtain the effect of correcting the posture of the saddle-stitched booklet in the vertical state by the first sandwiching operation.

The configuration of the sandwiching section is not limited to the above embodiments as long as it can sandwich the saddle-stitched booklet from both sides in the X direction.

It is also preferable to change at least one setting among the pressing force, sandwiching time and the number of times of sandwiching the sheets with the sandwiching section in the first sandwiching operation on the basis of at least one condition of the number of sheets, sheet type and basis weight of the sheets forming the saddle-stitched booklet.

In this case, for example, as shown in FIG. 8, a setting table T1 is stored in the storage section 505*a* in advance, the setting table T1 being for setting the pressing force of the sandwiching section (a pair of sandwiching plates 342 and 343 and a pair of pressing rollers 344 and 345) according to the number of sheets and basis weight. When executing the first sandwiching operation, the sheet processing control section 505 determines the strength of the pressing force according to the number of sheets and the basis weight, and selects the first predetermined distance which is set according to the strength in advance.

FIG. 8 shows an example in which the strength of the pressing force in the first sandwiching operation is determined according to the number of sheets and basis weight; however, the sandwiching time in the first sandwiching operation may be set according to the number of sheets and basis weight and the number of times of sandwiching to be executed in the first sandwiching operation may be set according to the number of sheets and basis weight.

Alternatively, for example, the strength of pressing force in the first sandwiching operation, sandwiching time in the first sandwiching operation or the number of times of sandwiching to execute the first sandwiching operation may be set according to the number of sheets and sheet type (for example, three types of coated paper, high-quality paper and others).

When using the pair of pressing rollers 344 and 345 as the sandwiching section which performs the first sandwiching operation, the number of rotation of the pair of pressing rollers 344 and 345 may be changed.

By such configuration, it is possible to execute an appropriate first sandwiching operation according to each saddle-stitched booklet and correct the posture of the saddle-stitched booklet more effectively.

The entire disclosure of Japanese Patent Application No. 2014-019218 filed on Feb. 4, 2014 including description, claims, drawings, and abstract are incorporated herein by reference in its entirety.

What is claimed is:

1. A sheet processing apparatus which vertically conveys a sheet bundle including a number of sheets forming a booklet and which performs sheet processing, each sheet of the sheet bundle having a folded part at a middle portion thereof and being in a vertical state with the folded part up and an edge part down, and the apparatus comprising:

a supporting section which supports the folded part of each sheet of the sheet bundle from below;

a sandwiching section that includes a pair of sandwiching members, said sandwiching members sandwiching both sides of the sheet bundle which includes all of the sheets forming the booklet and which is supported by the supporting section;

a control section which controls the sandwiching section to execute a first sandwiching operation of sandwiching the sheet bundle including only all of the sheets forming the booklet, to release the first sandwiching operation, and thereafter to execute a second sandwiching operation of sandwiching again the sheet bundle including only all of the sheets forming the booklet, a number of the sheets sandwiched in the second sandwiching operation being the same as a number of the sheets sandwiched in the first sandwiching operation; and a post-processing section that performs post-processing on the sheet bundle including the number of sheets forming the booklet while the sandwiching section executes the second sandwiching operation to the sheet bundle by using the sandwiching members.

2. The sheet processing apparatus of claim 1, wherein, when the first sandwiching operation by the sandwiching section is released, the control section controls the sandwiching section to keep the sandwiching members in contact with the sheet bundle.

3. The sheet processing apparatus of claim 1, wherein the control section controls the sandwiching section to sandwich the sheet bundle in the first sandwiching operation with a pressing force which is smaller than a pressing force of the sandwiching section to sandwich the sheet bundle in the second sandwiching operation.

4. The sheet processing apparatus of claim 1, wherein:

the sandwiching section includes a pair of plates as the sandwiching members and a plate driving section which drives the pair of plates, and the control section controls the plate driving section to execute the first sandwiching operation and the second sandwiching operation with the pair of plates.

5. The sheet processing apparatus of claim 4, wherein:

the sandwiching section further includes a pair of rollers and a roller driving section which drives the pair of rollers, after the first sandwiching operation is released, the control section controls the roller driving section to make the pair of rollers contact with both sides of the sheet bundle and to execute a rotating operation of rotating the pair of rollers in a direction that pulls outermost sheets of the sheet bundle downward by moving the sheet bundle downward while the supporting section supports the sheet bundle from below, and the control section controls the plate driving section to execute the second sandwiching operation by the pair of plates during the rotating operation of the pair of rollers or after the rotating operation is finished.

6. The sheet processing apparatus of claim 5, further comprising an ejection section which ejects the sheet bundle in a state that the folded part of each sheet in the sheet bundle is at a forefront of the sheet bundle in a direction in which the sheet bundle is ejected, wherein after the second sandwiching operation is finished, the control section controls the roller driving section to execute a back rotating operation of rotating the pair of rollers in a direction that the sheet bundle moves upward in a state in which the pair of rollers contacts with both sides of the sheet bundle, and to pass the sheet bundle to the ejection section.

7. The sheet processing apparatus of claim 1, wherein:

the sandwiching section includes a pair of plates and a pair of rollers as the sandwiching members, a plate driving section which drives the pair of plates and a roller driving section which drives the pair of rollers, and the control section controls the roller driving section to execute the first sandwiching operation with the pair of rollers, and controls the plate driving section to execute the second sandwiching operation with the pair of plates.

8. The sheet processing apparatus of claim 7, wherein, after the first sandwiching operation by the pair of rollers is released, the control section controls the roller driving section to make the pair of rollers contact with both sides of the sheet bundle, to execute a rotating operation of rotating the pair of rollers in a direction that pulls outermost sheets of the sheet bundle downward by moving the sheet bundle downward while the supporting section supports the sheet bundle from below, and to execute the second sandwiching operation by the pair of plates during the rotating operation of the pair of rollers or after the rotating operation is finished.

9. The sheet processing apparatus of claim 1, wherein the control section changes at least one setting among a pressing force, a sandwiching time and a number of sandwichings by the sandwiching members with respect to the sheet bundle in the first sandwiching operation, based on at least one condition among a sheet type, the number of sheets and a sheet basis weight.

10. The sheet processing apparatus of claim 1, further comprising a trimming section which performs trimming of an edge of each sheet in the sheet bundle after the sandwiching section executes the second sandwiching operation.

11. The sheet processing apparatus of claim 1, further comprising a square back forming section which performs square back forming of the folded part of each sheet in the sheet bundle after the sandwiching section executes the second sandwiching operation.

12. An image forming system, comprising:

an image forming apparatus which forms an image on each sheet in the sheet bundle; and the sheet processing apparatus of claim 1 which is connected to the image forming apparatus and which vertically conveys the sheet bundle on each sheet of which the image is formed by the image forming apparatus.

13. A sheet processing apparatus which vertically conveys a sheet bundle including a number of sheets forming a booklet and which performs sheet processing, each sheet of the sheet bundle having a folded part at a middle portion thereof and being in a vertical state with the folded part up and an edge part down, and the apparatus comprising:

a supporting section which supports the folded part of each sheet of the sheet bundle from below;

a sandwiching section that includes a pair of sandwiching members, said sandwiching members sandwiching both sides of the sheet bundle which includes the number of sheets forming the booklet and which is supported by the supporting section;

a control section which controls the sandwiching section to execute a first sandwiching operation of sandwiching the sheet bundle including the number of sheets forming the booklet, to release the first sandwiching operation, and thereafter to execute a second sandwiching operation of sandwiching again the sheet bundle including the number of sheets forming the booklet; and a post-processing section that performs post-processing on the sheet bundle including the number of sheets forming the booklet while the sandwiching section executes the second sandwiching operation to the sheet bundle by using the sandwiching members, wherein the control section controls the sandwiching section to sandwich the sheet bundle in the first sandwiching operation with a pressing force which is smaller than a pressing force of the sandwiching section to sandwich the sheet bundle in the second sandwiching operation.

14. An image forming system, comprising:

an image forming apparatus which forms an image on each sheet in the sheet bundle; and the sheet processing apparatus of claim 13 which is connected to the image forming apparatus and which vertically conveys the sheet bundle on each sheet of which the image is formed by the image forming apparatus.

* * * * *